United States Patent [19]

Knapp, Jr.

[11] 4,023,133

[45] May 10, 1977

[54] BLOWN FUSE INDICATOR

[75] Inventor: Edward J. Knapp, Jr., Merrimac, Mass.

[73] Assignee: The Chase-Shawmut Company, Newburyport, Mass.

[22] Filed: Mar. 15, 1976

[21] Appl. No.: 666,942

[52] U.S. Cl. ..... 337/206; 337/244

[51] Int. Cl.[2] ..... H01H 85/30

[58] Field of Search ..... 337/142, 144, 148, 150, 337/154, 155, 206, 244, 161, 162

[56] References Cited

UNITED STATES PATENTS

| | | | |
|---|---|---|---|
| 891,323 | 6/1908 | Brown | 337/244 |
| 2,249,014 | 7/1941 | Lingal et al. | 337/206 X |
| 3,621,433 | 11/1971 | Beicher | 337/244 |
| 3,742,414 | 6/1973 | Gittin et al. | 337/206 |

*Primary Examiner*—Robert J. Hickey
*Attorney, Agent, or Firm*—Erwin Salzer

[57] ABSTRACT

A blown fuse indicator is supported by a socket separate from the casing of the fuse whose blowing the indicator is supposed to indicate. The indicator includes an indicating pin of relatively large size under the bias of a relatively powerful helical spring. The pin is biased in a direction at right angles to the longitudinal axis of the fuse, or of its casing, respectively. Normally the pin is restrained by a latch projecting into a recess in the lateral wall of the pin. The latch is spring biased in the pinrestraining position thereof. When the bias of the latch is overcome by an external force, the pin moves to the indicating position thereof.

4 Claims, 3 Drawing Figures

BLOWN FUSE INDICATOR

BACKGROUND OF THE INVENTION

Electric fuses are generally provided with blown fuse indicators in the form of a spring-biased indicating pin, normally held in position by a restraining wire, and allowed to move to a blown fuse indicating position in response to blowing of the fuse and subsequent melting of the restraining wire. Generally blown fuse indicating pins are arranged at one of the end surfaces of the fuse. Since the space available at this location is relatively limited, the pins are generally of small size. This fact combined with the fact that the end surfaces of fuses are generally much less exposed to view than the lateral surfaces thereof, imposes serious limitations on the usefulness of blown fuse indicators of the aforementioned conventional type.

In an effort to achieve a more conspicuous indication of whether or not a fuse has blown, blown fuse indicators have been arranged at the lateral surfaces of fuses, or their casings, respectively. This arangement greatly facilitates the supervision and maintenance of fuse-protected electric distribution systems, but requires the provision of a perforation or hole in the lateral wall of the casing of such fuses, which impairs the mechanical integrityof the casing.

It is, therefore, one of the prime objects of this invention, to provide highly visible or conspicuous blown fuse indicating means on the lateral surfaces of the casings of electric fuses, without any impairment of the mechanical integrity of the casings.

Another object of the invention is to provide means allowing to convert electric fuses having conventional relatively small and inconspicuous blown fuse indicator pins on one of the end surfaces thereof into fuses having relatively large and conspicuous blown fuse indictor pins on the lateral surfaces thereof.

Other objects and advantages of the invention will become apparent as this specification proceeds.

SUMMARY OF THE INVENTION

Structures embodying this invention include in combination a. an electric fuse having a cylindrical casing and a first blown fuse indicator including a first blown fuse indicating pin means of relatively small size arranged adjacent one of the end surfaces of said fuse and movable in a direction longitudinally of the axis of said casing;

b. an insulating socket arranged adjacent to the lateral surface of said casing affixed to said casing;

c. a second blown fuse indicator supported by said socket, said second blown fuse indicator including a second blown fuse indicating pin means of relatively large size, a helical compression spring biasing said second pin means at right angles to the general plane defined by said socket and a latch under the action of an additional spring normally restraining said second pin means; and d. means responsive to operation of said first pin means for operating said latch against the action of said additional spring to cause operation of said second pin means under the action of said helical spring.

DESCRIPTION OF PREFERRED EMBODIMENTS

Figure 1:
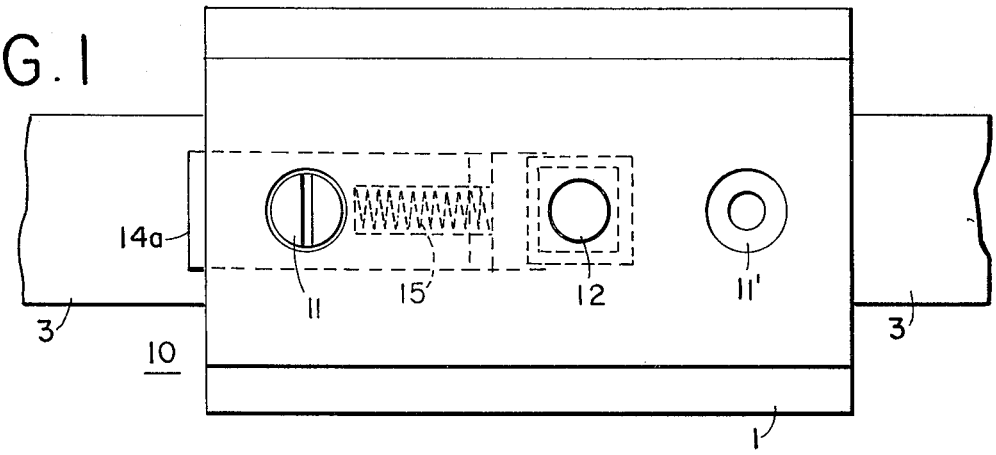
FIG. 1 is a top-plan view of an assembly embodying this invention.

In the drawings reference numeral 1 has been applied to indicate the casing of an electric fuse whose ends are closed by terminal plugs 2. Blade contacts 3 project away from terminal plugs 2. Casing 1 is filled with a granular arc-quenching filler 4 into which fusible element 5 is immersed. The latter may be formed by a strip of silver conductively interconnecting terminal plugs 2. Each terminal plug 2 is provided with a bore **2*a*. A cap 6 is inserted into right bore 2*a* and clamps the high resistance wire 7 against the lateral wall of said bore.Three caps 6*a*, 6*b*, 6*c* are arranged inside of left bore 2*a*. Cap 6*a* defines a void or space from which arcquenching filler 4 is excluded. A helical spring 8 is arranged between caps 6*b*, 6*c*. The former frictionally engages left bore 2*a* in such a way as to preclude any movement relative to it, or relative to left terminal plug 2, respectively. Cap 6*c* is biased by spring 8 from right to left. Pin 9 is affixed to cap 6*c* and its right end forms a perforated tab 9*a* to which the left end of wire 7 is affixed. The fuse forms a first current path 3,2,5,2,3, of small resistance and a shunt path 3,6,7,9*a*,9,6*c*,6*b*,2,3 of high resistance. Melting and vaporization of fusible element 5 interrupts the first mentioned current path, and thereafter the second mentioned current path begins to carry current. As a result, wire 7 melts and cap 6*c* is propelled by spring 8 from right to left. Cap 6*c*** is generally painted red and referred to as blown fuse indicating pin.

Reference character 10 has been aplied to generally indicatean insulating socket arranged adjacent to the lateral surface of casing 1 and affixed to the latter by fastener or screw 11. Socket 10 includes an upper portion **10*a* defining a system of cavities for receiving various parts and a lower portion or base plate 10b. Portions 10*a* and 10*b* are held together by two rivet-like eyelets 11'. Screw 11 projects through left fastener 11'. Socket 10*a*, 10*b* supports the blown fuse indicating pin 12 which is of relatively large size compared to that of cap 6*c*, the helical compression spring 13 biasing pin 12 at right angles to the general plane defined by socket 10, and latch 14 under the action of additional spring 15. Socket portion 10*a* is provided with an opening for the passage of indication pin 22. Latch 14 projects into a recess 12*a* in the lateral surface of pin 12. The longitudinal axes of pin 12 and that of helical spring 13 are arranged in spaced parallel relation. This makes for great compactness in spite of the relatively large size of the pin 12. The latch 14 is angularly bent 90° at two points and has an extension 14*a* positioned in front of cap 6*c* and the left end of pin 9. Extension 14*a* is a means responsive to operation of parts 6*c* and 9 for operating latch 14 against the bias of spring 15 to cause operation of pin means 12 under the action of helical spring 13. When latch 14 is moved from right to left under the action of spring 8 and against the action of spring 15, latch 14 moves out of recess 13 to move pin 12 in upward direction. Latch 14 is provided with an elongated slot 14*b* through which left fastener 11' projects. This slot 14*b* allows latch 14 to move from right to left for unlatching pin 12, and from left to right, for latching pin 12. When pin 12 is depressed manually following blowing of the fuse and replacement of it by a new fuse which is intact, latch 14 reenters recess 12***a* under the action of biasing spring 15.

It will be noted that screw 11 projects through casing 1 into the left terminal plug 2. The mechanical integrity of casing 1 is not impaired as a result of this arrangement of screw 11 because there is no removal of material from the wall of the casing 1 at a region thereof where a high bursting strength is often required. If desired, the unit 10 may be affixed to casing 1 by means of a strap or band, thus avoiding the provision of a perforation in casing 1 for affixing unit 10 to the former.

Figure 2:
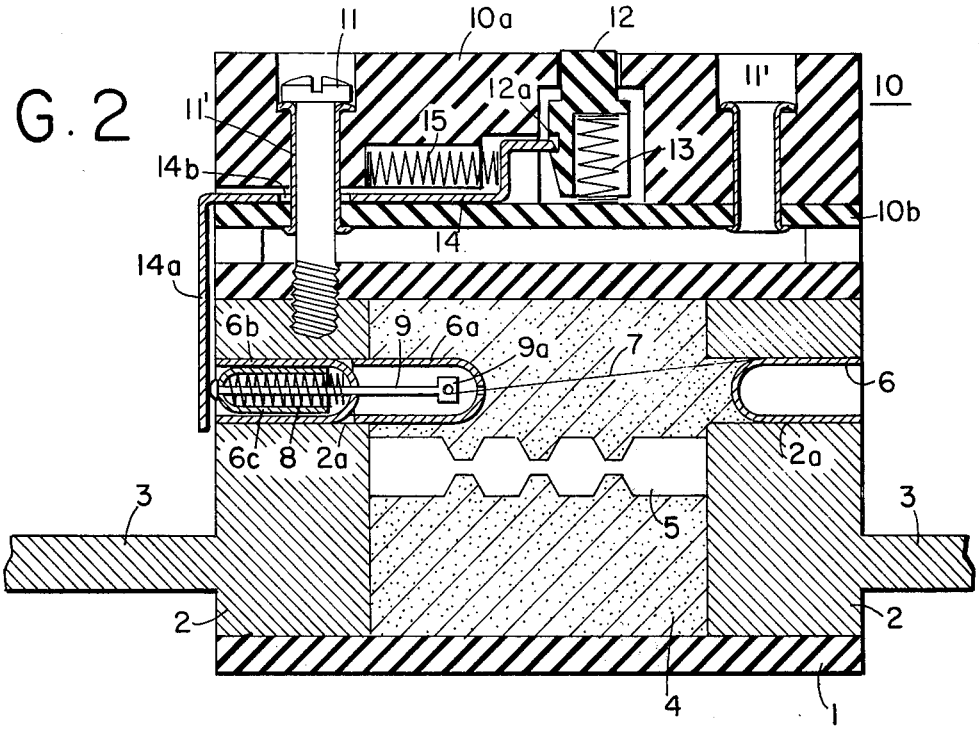
FIG. 2 is, in substance, a vertical section of the structure of FIG. 1.
Figure 3:
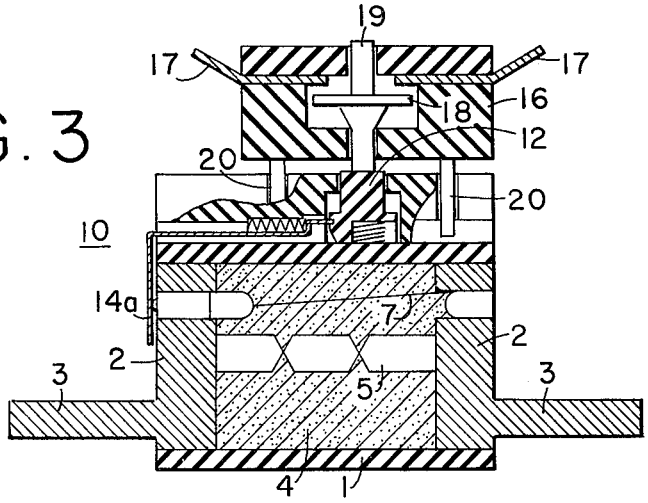
FIG. 3 shows the structure of FIGS. 1 and 2 in the same way as FIG. 2 though on a smaller scale than FIG. 2 with an auxiliary switching device added to the structure.

In FIG. 3 the same reference characters as in FIGS. 1 and 2 have been applied to indicate like parts. Thus FIG. 3 requires a detailed description only to the extent that the structure shown therein differs from that shown in FIGS. 1 and 2. As shown in FIG. 3, a fuse has a casing 1 closed by terminal plugs 2 having blade contacts 3. Casing 1 is filled with a granular arc-quenching filler 4 and termainal elements 2 are conductively interconnected by two current paths of which one has a low resistance and is formed by fusible element 5, and the other has a high resistance and includes the restraining wire 7 for an inconspicuous small blown fuse indicator such as that described in detail in connection with FIGS. 1 and 2. This blown fuse indicator acts upon arm 14a of a latch for a system supported by a socket 10 which system is identical to the system shown in FIGS. 1 and 2 as being supported by socket 10 and described in the context of FIGS. 1 and 2. As shown in FIG. 3, socket 10 supports an additional socket 16 of insulating material by means of two projections 20 extending from socket 16 into corresponding recesses provided therefor in socket 10. The additional socket 16 supports switch means including cooperating contacts, i.e. the fixed contacts 17 and the movable bridge contact 18. The latter is supported by insulating pin 19 whose lower end rests upon pin 12 (shown in detail in FIG. 2). Contacts 17 are intended to control a circuit for remote indication of whether or not any particular fuse has blown. Upon blowing of fuse 1,2,3,4,5,7 part 14a is moved from right to left, as seen in FIGS. 2 and 3, causing unlatching of pin 12. As a result, both pins 12 and 19 are projected upwardly by spring 13. This causes engagement of contacts 17b and contact 18, and closing of a circuit whose function is remote indication of the fact that the fuse has blown.

I claim as my invention:

1. In combination a. an electric fuse having a cylindrical casing and a first blown fuse indicator including a first blown fuse indicating pin means of relatively small size arranged adjacent one of the end surfaces of said fuse and movable in a direction longitudinally of the axis of said casing;

b. an insulating socket arranged adjacent to the lateral surface of said casing and affixed to said casing;

c. a second blown fuse indicator supported by said socket, said second blown fuse indicator including a second blown fuse indicating pin means of relatively large size, a helical compression spring biasing said second pin means at right angles to the general plane defined by said socket, and a latch under the action of an additional spring normally restraining said second pin means; and d. means responsive to operation of said first pin means for operating said latch against the action of said additional spring to cause operation of said second pin means under the action of said helical spring.

2. A combination as specified in claim 1 wherein said second pin means has a recess in the lateral surface thereof, and wherein the longitudinal axes of said second pin means and of said helical spring are arranged in spaced parallel relation.

3. A combination as specified in claim 1 wherein a. said socket supports an additional insulating socket;

b. said additional socket supports switch means including co-operating fixed contacts and movable contacts; and wherein c. said movable contacts are arranged to be operated by said second pin means. Socket portion 10*a* is provided with an opening for the passage of indicator pin 12.

4. In combination a. an electric fuse having a casing and a first blown fuse indicator arranged adjacent one of the end surfaces of said casing and movable in a direction longitudinally thereof;

b. a separate socket of insulating material arranged adjacent to and affixed to said casing of said fuse, said socket having an opening for the passage of an indicator pin;

c. an indicator pin of relatively large dimensions arranged inside said socket under the bias of a relatively powerful helical spring tending to move said indicator pin through said opening in said socket, said indicator pin having a recess to be engaged by a latch;

d. a latch spring biased by an additional spring to engage said recess, and said latch being operated against the action of said latch biasing spring and movable in the operating direction of said first blown fuse indicator to release said indicator pin.

* * * * *